US008157255B2

(12) United States Patent
Nishimura et al.

(10) Patent No.: US 8,157,255 B2
(45) Date of Patent: Apr. 17, 2012

(54) INSERTER

(75) Inventors: Shunsuke Nishimura, Toride (JP); Manabu Yamauchi, Kashiwa (JP); Naoto Watanabe, Abiko (JP); Takayuki Fujii, Tokyo (JP); Yushi Oka, Abiko (JP); Toshiyuki Miyake, Abiko (JP); Takashi Yokoya, Kashiwa (JP); Hidenori Matsumoto, Kashiwa (JP); Satoru Yamamoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/234,347

(22) Filed: Sep. 16, 2011

(65) Prior Publication Data

US 2012/0007302 A1 Jan. 12, 2012

Related U.S. Application Data

(62) Division of application No. 12/487,092, filed on Jun. 18, 2009, now Pat. No. 8,038,139.

(30) Foreign Application Priority Data

Jun. 18, 2008 (JP) ..... 2008-159157

(51) Int. Cl.
*B65H 33/04* (2006.01)

(52) U.S. Cl. ..... 270/58.23; 270/58.31; 270/58.25

(58) Field of Classification Search ..... 270/58.07, 270/58.23, 58.25, 58.29, 58.31
See application file for complete search history.

(56) References Cited

U.S. PATENT DOCUMENTS

| | | | |
|---|---|---|---|
| 4,768,063 | A | 8/1988 | Kunishima et al. |
| 6,098,977 | A | 8/2000 | Sato et al. |
| 6,636,720 | B2 | 10/2003 | Fujii et al. |
| 6,647,240 | B2 | 11/2003 | Fujii |
| 6,836,640 | B2 | 12/2004 | Isemura et al. |
| 6,904,261 | B2 | 6/2005 | Fujii et al. |
| 7,591,459 | B2 | 9/2009 | Matsumoto et al. |
| 7,878,497 | B2 | 2/2011 | Adachi |
| 2007/0228639 | A1 | 10/2007 | Matsumoto et al. |
| 2009/0206540 | A1 | 8/2009 | Adachi |

FOREIGN PATENT DOCUMENTS

| | | |
|---|---|---|
| JP | 2003-221160 | 8/2003 |
| JP | 2004-051268 | 2/2004 |
| JP | 2005-089009 | 7/2005 |

*Primary Examiner* — Leslie A Nicholson, III
(74) *Attorney, Agent, or Firm* — Fitzpatrick, Cella, Harper & Scinto

(57) ABSTRACT

The inserter including a storing unit, a sheet-feeding unit; a conveyance unit; and a controller that determines for every sheet a conveying speed of the sheet to be discharged to the downstream side device by the conveyance unit, in which the controller determines: the conveying speed of the sheet, which was discharged from the image forming apparatus, when the sheet is discharged to the downstream side device by the conveyance unit, based on the conveying speed when the inserter receives the sheet discharged from the image forming apparatus; and a conveying speed of the insert-sheet, which was fed by the sheet-feeding unit, when the insert-sheet is discharged to the downstream side device by the conveyance unit, based on a conveying speed of one of a preceding sheet and a succeeding sheet, when one of the preceding sheet and the succeeding sheet is discharged to the downstream side device.

4 Claims, 8 Drawing Sheets

FIG. 7

| THE NUMBER OF SHEETS | THE NUMBER OF COPY | THE TYPES OF SHEETS | SHEET PASS-OVER IMAGE SURFACE FROM IMAGE FORMING APPARATUS 101 TO INSERTER 102 | SHEET PASS-OVER SPEED FROM IMAGE FORMING APPARATUS 101 TO INSERTER 102 | SHEET PASS-OVER SPEED FROM INSERTER 102 TO FINISHER 103 |
|---|---|---|---|---|---|
| THE FIRST SHEET | THE FIRST COPY | PRINTED SHEET | FACE-UP | Vu | Vu |
| THE SECOND SHEET | THE FIRST COPY | INSERT-SHEET | — | — | Vu |
| THE THIRD SHEET | THE FIRST COPY | PRINTED SHEET | FACE-UP | Vu | Vu |
| NECESSARY TIME TO SWITCH THE FINISHER SPEED | | | | | 0 |

FIG. 8

| THE NUMBER OF SHEETS | THE NUMBER OF COPY | THE TYPES OF SHEETS | SHEET PASS-OVER IMAGE SURFACE FROM IMAGE FORMING APPARATUS 101 TO INSERTER 102 | SHEET PASS-OVER SPEED FROM IMAGE FORMING APPARATUS 101 TO INSERTER 102 | SHEET PASS-OVER SPEED FROM INSERTER 102 TO FINISHER 103 |
|---|---|---|---|---|---|
| THE FIRST SHEET | THE FIRST COPY | PRINTED SHEET | — | — | Vd |
| THE SECOND SHEET | THE FIRST COPY | PRINTED SHEET | FACE-DOWN | Vd | Vd |
| THE THIRD SHEET | THE FIRST COPY | PRINTED SHEET | FACE-UP | Vu | Vu |
| THE FOURTH SHEET | THE FIRST COPY | INSERT-SHEET | — | — | Vu |
| THE FIFTH SHEET | THE SECOND COPY | INSERT-SHEET | — | — | Vd |
| THE SIXTH SHEET | THE SECOND COPY | PRINTED SHEET | FACE-DOWN | Vd | Vd |
| THE SEVENTH SHEET | THE SECOND COPY | PRINTED SHEET | FACE-UP | Vu | Vu |
| THE EIGHTH SHEET | THE SECOND COPY | INSERT-SHEET | — | — | Vu |
| NECESSARY TIME TO SWITCH THE FINISHER SPEED | | | | | 3 |

INSERTER

This application is a divisional of U.S. patent application Ser. No. 12/487,092, filed Jun. 18, 2009, and allowed Jun. 16, 2011.

BACKGROUND OF THE INVENTION

1. Field of the Invention

The present invention relates to an inserter which is connected to an image forming apparatus, for supplying an insert-sheet.

2. Description of the Related Art

Conventionally, in the image forming apparatuses such as copying machines, some are provided with function modes such as a cover mode and an interleaving sheet mode for inserting a cover or an interleaving sheet to a plurality of sheets having images formed thereon, to thereby perform book binding or the like.

Those modes are provided for inserting, as a cover, an interleaving sheet, or a back cover, a sheet for insertion (hereinafter, referred to as "insert-sheet") which is different from the sheet having an image formed thereon, to a first page, last page, or middle page of the plurality of sheets having images formed thereon. This inserting operation is carried out on a tray on which the sheets having images formed thereon are to be stacked, for forming a sheet set (bundle) in which the insert-sheets are inserted to predetermined positions of the plurality of sheets having images formed thereon.

In the cover mode and the interleaving sheet mode described above, arbitrary settings may be made about a sheet insertion position (at what page) or a number of insertions of sheets to be inserted with respect to the sheet-bundle to be formed.

Further, with respect to the sheet set, to which the insert-sheet is inserted, processing per bundle, namely, post processing such as bundle discharge processing, stapling processing, folding processing, or book binding may be made in a post processing apparatus (sheet processing apparatus) such as a finisher installed in the image forming apparatus.

Hereinafter, operation modes for inserting, as the cover, the interleaving sheet, and the back cover, the insert-sheet fed from the insert-sheet container unit are generally called an sheet insertion mode.

As a method (mechanism) of supplying the insert-sheet, there is given a method involving supplying the insert-sheet using one of a plurality of sheet feeder cassettes provided to the image forming apparatus. In this method, if timing for inserting the insert-sheet comes, the sheet feeder cassette in which the insert sheet is stored is selected, and the insert-sheet is fed to a conveying path as well as recording sheets for image formation.

Then, the fed insert-sheet is laid on the recording sheets having images formed thereon on the tray of the sheet processing apparatus. With this operation, there is produced a sheet set in which the insert-sheet is incorporated.

In a midway of the above-mentioned path, for example, in an image forming apparatus using an electrophotographic system, there is arranged a fixing unit for fixing toner images for forming the images on the sheets, and hence the insert-sheet passes through the fixing unit, resulting in being heat-pressed as well as the sheets on which images are formed.

In this case, if a color image print script is used as the insert-sheet, quality of the printing image may be impaired by being heat-pressed when the insert-sheet passes through the fixing unit.

Further, in recent years, as color images are increasingly used with spreads of personal computers, color copy paper and color print paper are used in many cases as the insert-sheets. For that reason, there occurs a problem in that quality of bookbinding or the like, which is subjected to bundling processing, lowers owing to deterioration of the insert-sheet.

Therefore, there has been seen an image forming system having a structure in which the inserter for supplying the insert-sheet is provided to the post processing device such as a finisher, which is installed to the image forming apparatus, to thereby supply the insert-sheet without causing to pass through the image forming apparatus (for example, refer to Japanese Patent Application Laid-Open No. 2003-221160).

In addition, due to recent rapid expansion of print on demand (POD) market, in a system which is built around the image forming apparatus of electrophotographic system, for carrying out the image formation in large quantity, there has been attempted employment of multistage sheet feeder cassettes, or capacity increase of the cassette in a sheet feeding apparatus. In this case, to the inserter, various and large amounts of preprint paper, a plurality of color paper, tab paper, or the like may be stored (for example, refer to Japanese Patent Application Laid-Open No. 2004-051268).

Further, the image forming apparatus of the electrophotographic system generally discharge the sheet to the downstream side device such as the inserter or the finisher under any one of the following states: a state in which an image formation surface faces downward (face-down); a state in which the image formation surface faces upward (face-up); and a state in which the image formation surfaces are both surfaces.

For that reason, when discharging the sheet in the face-down state, a front surface and a rear surface of the sheet are inverted by switch back. However, in order to prevent the next sheet from being fed during the switch back of the sheet, it is necessary for intervals of the sheets to widen. To cope with this, the sheet is discharged to the downstream side device at higher speed compared to the face-up discharge with no switch back (for example, refer to Japanese Patent Application Laid-Open No. 2005-089009).

However, in the conventional inserter, the insert-sheet is passed-over at constant speed to the downstream side device. In this case, conveying speed of the insert-sheet has no relation with changes in speeds of the sheets before and after the insert-sheet, which are conveyed from the image forming apparatus.

Further, the finisher switches over speeds of conveying rollers to receive the sheet to be conveyed at a speed selected from a plurality of speeds from the image forming apparatus and the sheet to be supplied at the constant speed from the inserter.

For that reason, in a job in which the inserter is used, the finisher is required to change the speeds of the conveying rollers for increased times, and hence the sheet interval is widened in order to gain time which is necessary for switching over the roller speed. As a result, productivity required for POD is significantly lowered.

SUMMARY OF THE INVENTION

It is an object of the present invention to provide an inserter capable of solving the above-mentioned problem.

It is another object of the present invention to provide an inserter capable of preventing productivity from lowering by changing conveying speed of the insert-sheet.

It is still another object of the present invention to provide an inserter for feeding an insert-sheet so that one set of a sheet bundle including a sheet and an insert-sheet, which are discharged from an image forming apparatus at any one of a plurality of speeds, is formed, the inserter comprising: a storing unit that stores the insert-sheet; a sheet-feeding unit that feeds the insert-sheet stored in the storing unit; a conveyance unit that discharges the sheet discharged from the image forming apparatus connected upstream of the inserter and the insert-sheet fed from the sheet-feeding unit to a downstream side device connected to downstream of the inserter; and a controller that determines for every sheet a conveying speed of the sheet to be discharged to the downstream side device by the conveyance unit, wherein the controller determines: the conveying speed of the sheet, which was discharged from the image forming apparatus, when the sheet is discharged to the downstream side device by the conveyance unit, based on the conveying speed when the inserter receives the sheet discharged from the image forming apparatus; and a conveying speed of the insert-sheet, which was fed by the sheet-feeding unit, when the insert-sheet is discharged to the downstream side device by the conveyance unit, based on a conveying speed of a succeeding sheet, which is discharged from the image forming apparatus next to the insert-sheet, when the succeeding sheet is discharged to the downstream side device.

It is yet another object of the present invention to provide an inserter for feeding an insert-sheet so that one set of a sheet bundle including a sheet and an insert-sheet, which are discharged from an image forming apparatus, is formed, the inserter comprising: a storing unit that stores the insert-sheet; a sheet-feeding unit that feeds the insert-sheet stored in the storing unit; a conveyance unit that discharges the sheet discharged from the image forming apparatus connected upstream of the inserter and the insert-sheet fed from the sheet-feeding unit to a downstream side device connected to downstream of the inserter; and a controller that determines for every sheet a conveying speed of the sheet to be discharged to the downstream side device by the conveyance unit, wherein the controller determines that: a conveying speed of a sheet, which is received from the image forming apparatus at a first speed, when the sheet is discharged to the downstream side device by the conveyance unit, is the first speed; a conveying speed of a sheet, which is received from the image forming apparatus at a second speed, when the sheet is discharged to the downstream side device, is the second speed; and a conveying speed of the insert-sheet, which is fed by the sheet-feeding unit, when the insert-sheet is discharged to the downstream side device by the conveyance unit, based on a conveying speed of a succeeding sheet, which is discharged from the image forming apparatus next to the insert-sheet, when the succeeding sheet is discharged to the downstream side device.

It is a further object of the present invention to provide an inserter for feeding an insert-sheet so that one set of a sheet bundle including a sheet and an insert-sheet, which are discharged from an image forming apparatus at any one of a plurality of speeds, is formed, the inserter comprising: a storing unit that stores the insert-sheet; a sheet-feeding unit that feeds the insert-sheet stored in the storing unit; a conveyance unit that discharges the sheet discharged from the image forming apparatus connected upstream of the inserter and the insert-sheet fed from the sheet-feeding unit to a downstream side device connected to downstream of the inserter; and a controller that determines for every sheet a conveying speed of the sheet to be discharged to the downstream side device by the conveyance unit, wherein the controller determines: the conveying speed of the sheet, which was discharged from the image forming apparatus, when the sheet is discharged to the downstream side device by the conveyance unit, based on the conveying speed when the inserter receives the sheet discharged from the image forming apparatus; in a case where the insert-sheet fed by the sheet-feeding unit is not an end sheet of one set of a sheet bundle, the conveying speed of the insert-sheet when the insert sheet is discharged to the downstream side device, based on a conveying speed of a succeeding sheet, when the succeeding sheet is discharged to the downstream side device; and in a case where the insert-sheet fed from the sheet-feeding unit is an end sheet of one set of a sheet bundle, the conveying speed of the insert-sheet when the insert sheet is discharged to the downstream side device, based on a conveying speed of a preceding sheet, when the sheet is discharged to the downstream side device.

It is still a further object of the present invention to provide an image forming apparatus system, comprising: an image forming apparatus that forms an image on a sheet to discharge the sheet at any of a plurality of speed; an inserter for feeding an insert-sheet so that one set of a sheet bundle including a sheet and an insert-sheet, which are discharged from an image forming apparatus, is formed, the inserter comprising: a storing unit that stores the insert-sheet; a sheet-feeding unit that feeds the insert-sheet stored in the storing unit; a conveyance unit that discharges the sheet discharged from the image forming apparatus connected upstream of the inserter and the insert-sheet fed from the sheet-feeding unit to a downstream side device connected to downstream of the inserter; a post-processing apparatus that conducts post-processing to the one set of the sheet-bundle including the plurality of sheets discharged from the inserter; and a controller that determines for every sheet a conveying speed of the sheet to be discharged to the post-processing apparatus by the conveyance unit, wherein the controller determines: the conveying speed of the sheet, which is discharged from the image forming apparatus, when the sheet is discharged to the post-processing apparatus by the conveyance unit, based on the conveying speed when the inserter receives the sheet discharged from the image forming apparatus; and a conveying speed of the insert-sheet, which is fed by the sheet-feeding unit, when the insert-sheet is discharged to the post-processing apparatus by the conveyance unit, based on a conveying speed of a succeeding sheet, which is discharged from the image forming apparatus next to the insert-sheet, when the succeeding sheet is discharged to the post-processing apparatus.

Further features of the present invention will become apparent from the following description of exemplary embodiments with reference to the attached drawings.

BRIEF DESCRIPTION OF THE DRAWINGS

FIG. 7 illustrates a method of controlling conveying speed for passing-over the insert sheet to a downstream side device in the insert controller of FIG. 3.

FIG. 8 illustrates a method of controlling conveying speed for passing-over the insert sheet to the downstream side device in the insert controller of FIG. 3.

DESCRIPTION OF THE EMBODIMENTS

Hereinafter, description is made of an embodiment of the present invention with reference to the drawings.

(Overall Structure)

Figure 1:
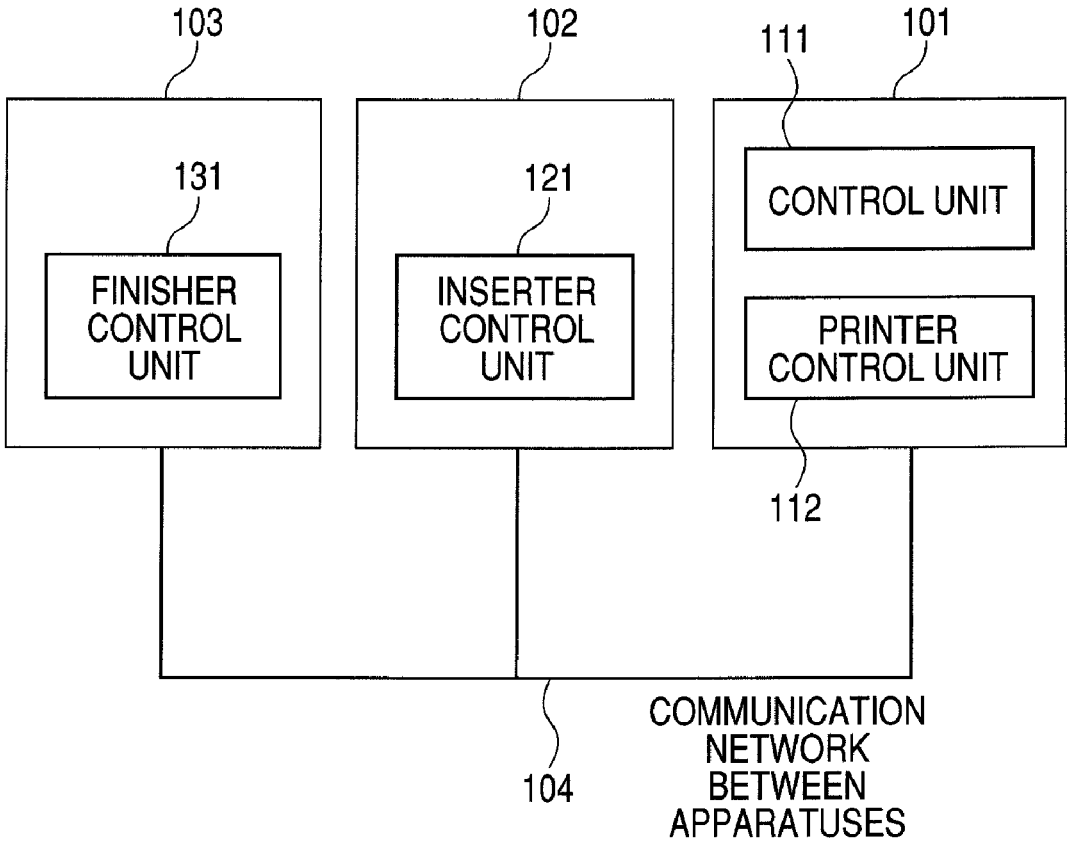
FIG. 1 is a block diagram illustrating an image forming system according to an embodiment of the present invention.

FIG. 1 is a block diagram illustrating an image forming system according to an embodiment of the present invention.

In FIG. 1, the image forming system of the present invention is constructed of: in the following order along the sheet carrying direction, an image forming apparatus (upstream apparatus) 101, an inserter (sheet supply device) 102, and a finisher (downstream side device) 103, while being connected through the communication network between apparatuses 104.

The image forming apparatus 101 includes a controller 111 for conducting a job management, and a printer controller 112 for conducting control of image formation on the sheet or control of sheet conveyance. Further, the inserter 102 and the finisher 103 include an inserter controller 121 and a finisher controller 131, respectively, for conducting the conveyance of the sheet.

The image forming apparatus 101, the inserter 102, and the finisher 103 exchange with each other sheet information necessary for sheet processing and timing information through the communication network between apparatuses 104.

Figure 2:
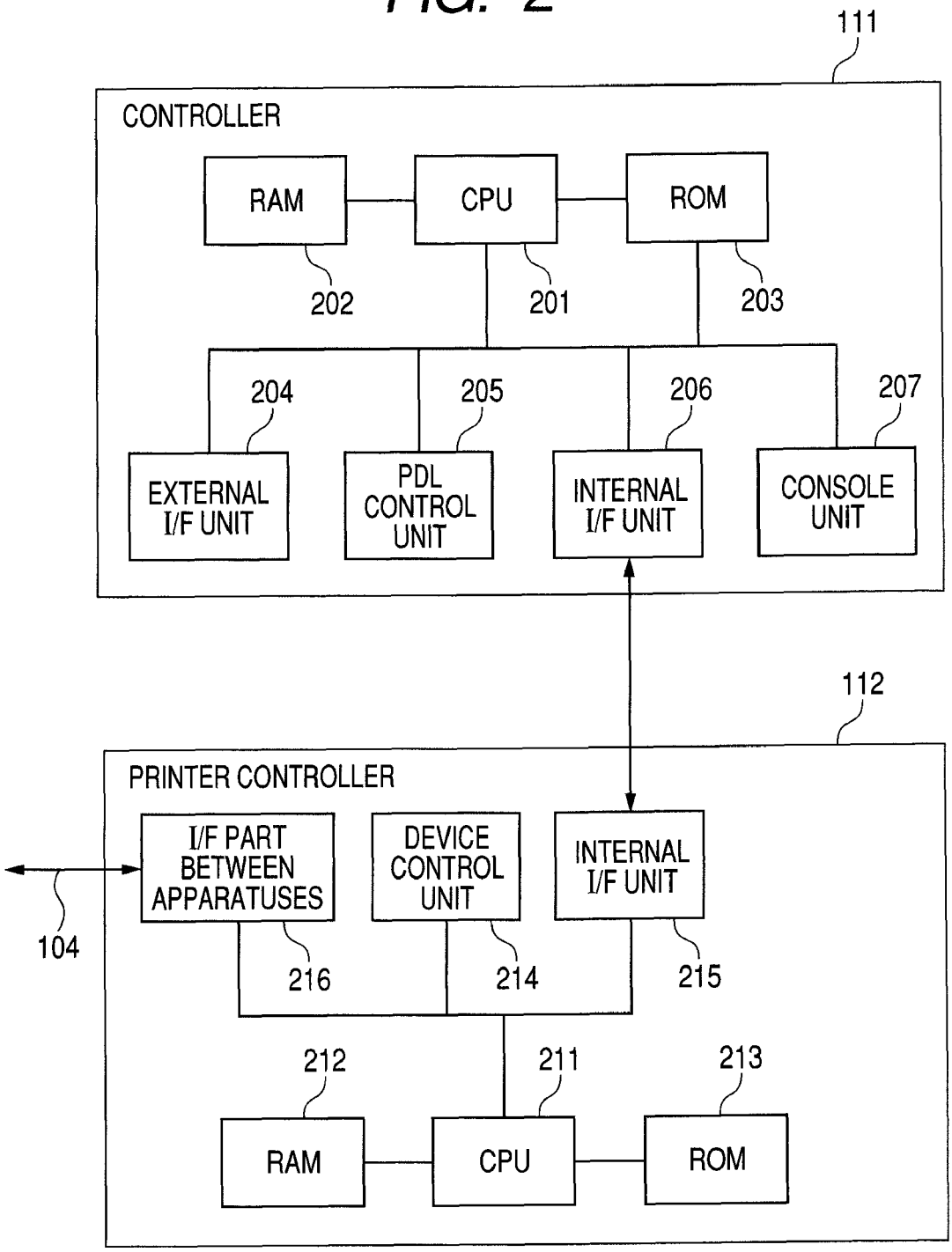
FIG. 2 is a control block diagram illustrating an internal structure of an image forming apparatus of FIG. 1.

FIG. 2 is a control block diagram illustrating an internal structure of an image forming apparatus of FIG. 1.

In FIG. 2, connected to a CPU 201 of the controller 111 are a RAM 202 for storing data for conducting processing, and a ROM 203 on which a control program is written, which are connected through an address bus and a data bus.

Further, an external I/F unit 204 for conducting communications with an exterior, a PDL controller 205 for conducting processing, accumulation, and image processing of received data, and an internal I/F unit 206 for conducting communications with the printer controller 112 are connected to the CPU 201.

In addition, an console unit 207 is connected to the CPU 201, and the CPU 201 controls display and key input of the console unit 207. The user instructs the CPU 201 to switch the display through key input, and the CPU 201 conducts, with respect to the console unit 207, the display of an operation state of the apparatus or an operation mode set through the key input.

A CPU 211 of the printer controller 112 conducts basic control of an image formation operation. To the CPU 211, a RAM 212 for storing data for conducting processing of the image formation operation and a ROM 213 on which a control program is written are connected through an address bus and a data bus.

It is regarded that a control procedure, and the like described later are stored on the ROM 213. A device controller 214 is an electric circuit including input/output ports, and the like for controlling respective components of the printer controller 112.

An internal I/F unit 215 exchanges an image signal and a timing signal with the controller 111. An I/F unit between apparatuses 216 exchanges the sheet information and the timing information with a sheet loading apparatus.

The CPU 211 receives an image signal from the controller 111 in accordance with contents of the control program through the internal I/F unit 215, and controls the device controller 214 to execute the image formation operation. Further, the CPU 211 exchanges the sheet information and the timing information with the other apparatuses through the I/F unit between apparatuses 216, to thereby execute the sheet conveyance operation.

Figure 3:
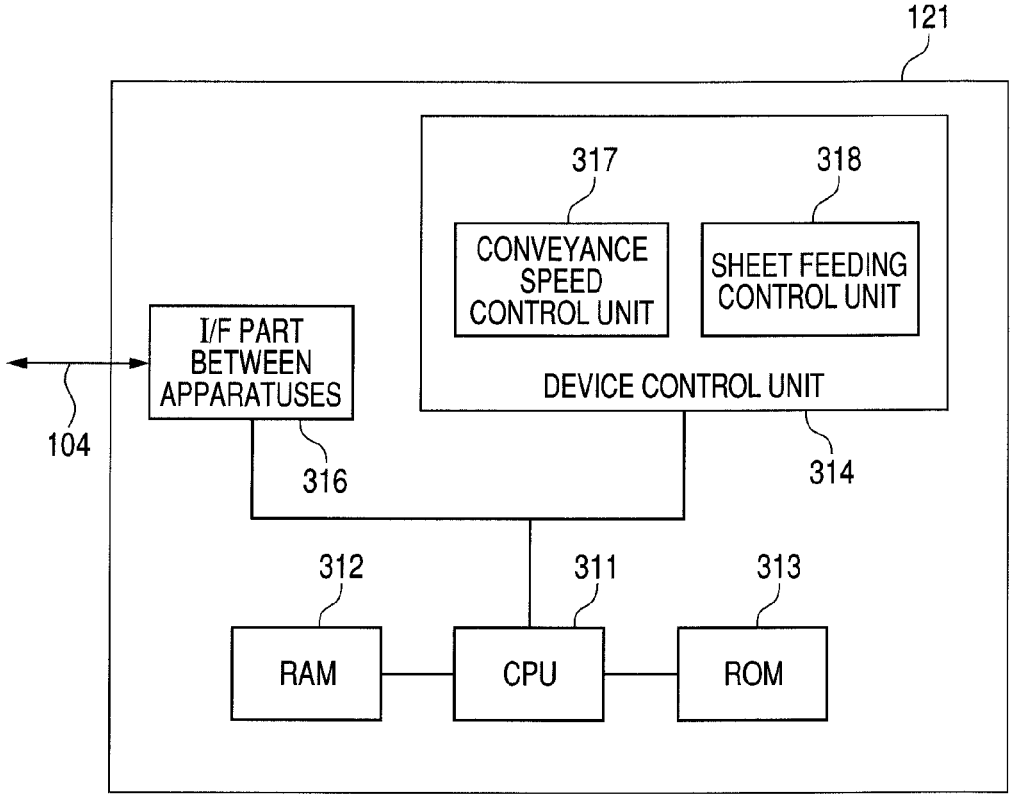
FIG. 3 is a control block diagram illustrating an internal structure of an inserter controller of FIG. 1.

FIG. 3 is a control block diagram illustrating an internal structure of an inserter controller of FIG. 1.

In FIG. 3, a CPU 311 conducts control of sheet conveyance and sheet processing. To the CPU 311, a RAM 312 for storing control data and a ROM 313 on which a control program is written are connected through an address bus and a data bus.

The ROM 313 stores a control procedure, and the like described later. A device controller 314 is an electric circuit including input/output ports, and the like for controlling respective components of the sheet loading apparatus.

The device controller 314 includes a conveying speed controller 317 for passing over the sheet to the finisher 103 and a sheet feeding controller 318 for feeding a sheet. The I/F unit between apparatuses 316 exchanges sheet information or timing information with the other sheet loading apparatus or the image forming apparatus.

Figure 4:
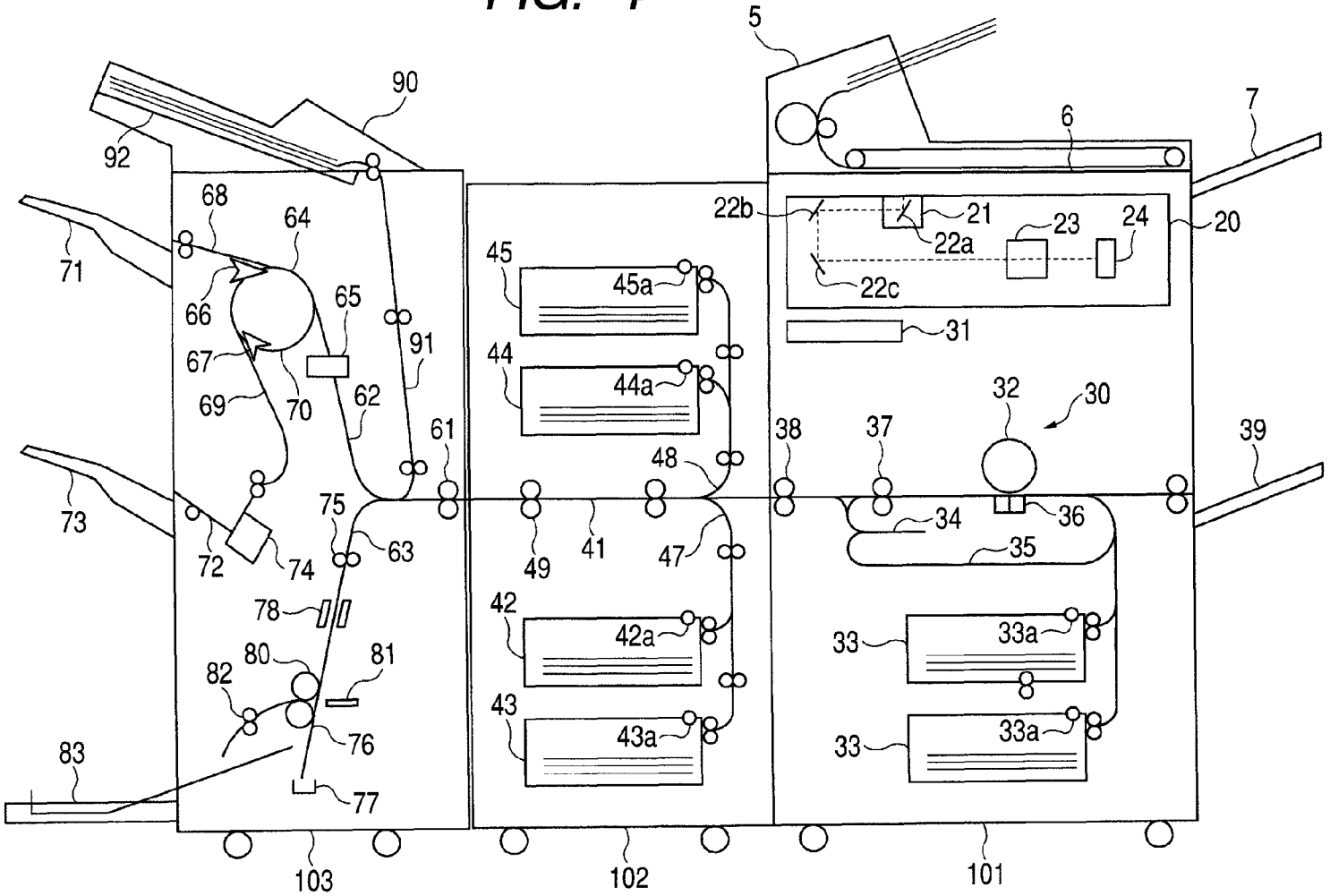
FIG. 4 is a structural diagram of the image forming system according to the embodiment of the present invention.

FIG. 4 is a structural diagram of the image forming system according to the embodiment of the present invention.

In FIG. 4, the image forming system includes the image forming apparatus 101, and the inserter 102 and the finisher 103 which are arranged in the stated order downstream of the image forming apparatus 101 (downstream side in sheet conveying direction).

The image forming apparatus 101 includes an image reader 20 for reading out an original image and a printer 30 as an image forming unit.

The automatic original feeding apparatus 5 is installed to the image reader 20. The automatic original feeding apparatus 5 feeds one by one in a left direction in order from the first page of the originals having image surfaces which are set upwardly on an original tray, and conveys the sheet through a curved path from left to a right direction on a platen glass 6 through an original flow reading position. Then, after that, the automatic original feeding apparatus 5 discharges (eject) the sheet toward an external discharge tray 7.

When the original to be conveyed passes through the original flow reading position on the platen glass 6 from the left toward the right, the original image is read out by a scanner unit 21 held at a position corresponding to the original flow reading position. This read-out method is generally called as an original flow reading method.

Specifically, when the original passes through the original flow reading position, a reading surface of the original is irradiated with light of a lamp (not shown) of the scanner unit 21, and reflection light from the original is introduced into a lens 23 through mirrors 22*a*, 22*b*, and 22*c*. The light, which passes through the lens 23, forms an image on an image pickup surface of an image sensor 24.

As described above, by conveying the original so as to pass through from the left to the right of the original flow reading position, original read-out scanning is carried out, in which a direction which is orthogonal to a conveying direction of the original is a main scanning direction and a conveying direction is a sub-scanning direction.

Specifically, when the original passes through the original flow reading position, while reading out the original for every one line in the main scanning direction by the image sensor 24, the original is conveyed in the sub-scanning direction, whereby read-out of an overall original image is carried out. An optically read-out image is converted into image data by the image sensor 24 to be output.

The image data output from the image sensor 24 is subjected to predetermined processing in the image signal controller, and then is input as a video signal to a light exposure controller 31 of the printer 30.

Note that, it is also possible to read-out the original by conveying the original on the platen glass 6 to be stopped at a predetermined position by the automatic original feeding apparatus 5, and under this state, by scanning from the left to right the scanner unit 21. This read-out method is a so-called original fixed reading method.

When reading-out the original without using the automatic original feeding apparatus 5, first, the automatic original feeding apparatus 5 is lifted by the user, and the original is placed on the platen glass 6. Then, the scanner unit 21 is scanned from the left to the right, to thereby read-out the original. Specifically, even in the case where the original is read-out without using the automatic original feeding apparatus 5, the original fixed reading is carried out.

The light exposure controller 31 of the printer 30 modulates a laser light based on an input video signal to output the laser light, and the laser light is irradiated onto a photosensitive drum 32 while being scanned by a polygon mirror.

Formed on the photosensitive drum 32 is an electrostatic latent image corresponding to a scanned laser light.

To the printer 30, there are provided a plurality of sheet feeder cassettes 33 for storing sheets for image formation, which is capable of being pulled out in a forward direction of the apparatus. Further, with separated sheet feeding units 33*a* provided so as to correspond to the respective sheet feeder cassettes 33, it is possible to provide the sheet one by one from the respective sheet feeder cassettes 33 to the printer 30.

Further, in a case of forming an image on another surface of the sheet having an image formed on one surface, i.e., so-called both-side copying, an invert path 34 for inverting the sheet having an image formed on the one surface, and a both-side conveying path 35 for supplying the inverted sheet again to the printer 30 are provided to the printer.

The electrostatic latent image formed on the photosensitive drum 32 is visualized as a developer image by a developer supplied from the developing device (not shown). Further, at timing synchronized with a start of laser light irradiation, the sheet is fed from the respective sheet feeder cassettes 33, or the both-side conveying path 35, and this sheet is conveyed between the photosensitive drum 32 and a transfer unit 36. The developer image formed on the photosensitive drum 32 is transferred onto the transfer unit 36.

The sheet, onto which the developer image is transferred, is conveyed to a fixing unit 37, and the fixing unit 37 fixes the developer image onto the sheet by heat-pressing the sheet. The sheet, which has passed through the fixing unit 37, is discharged toward the inserter 102 through the discharge roller 38 from the printer 30.

In this case, when the sheet is discharged under a state in which an image formation surface faces downward (face-down), the sheet which has passed through the fixing unit 37 is guided once into an invert path 34 by switching over a flapper (not shown) provided at a branching part with the invert path 34. Then, after a rear end of the sheet passes through the flapper, the sheet is switch-backed and is discharged by the discharge roller 38 from the printer 30. Hereinafter, this discharge mode is referred to as "inverted discharge".

This inverted discharge is carried out when forming an image which has been read-out by using the automatic original feeding apparatus 5, or when forming images in page order from the first page such as when forming images output from the computer. As a result, the sheet-bundle has a correct page order when being loaded on a tray 73 described later.

Besides, when a hard sheet such as an OHP (chewy) sheet is supplied from a manual sheet feed unit 39 to form an image on the sheet, the sheet is discharged by the discharge roller 38 under a state in which the image formation surface faces upward (face-up) without guiding the sheet to the invert path 34. With this, image formation on a sheet such as a hard sheet, which is liable to jam, is carried out.

In addition, if both recording mode, in which the image formation is carried out on both surfaces of the sheet, is set, by the switchover operation of the flapper (not shown) provided at the branch part of the invert path 34, the sheet is guided to the invert path 34, and then conveyed to the both-side conveying path 35. Then, a control is carried out so that the sheet which has been guided to the two-side conveying path 35 is fed again at predetermined timing between the photosensitive drum 32 and the transfer unit 36.

The sheet discharged from the printer 30 passes through a main conveying path 41 of the inserter 102 to be conveyed to a finisher 103. To the inserter 102, there are provided an insertion function of feeding a special sheet such as a cover and an interleaving sheet to be inserted to the sheets having images formed thereon by the image forming apparatus 101.

At the finisher 103, the sheets on which images are formed at the image forming apparatus 101, and the insert-sheet supplied from the inserter 102 are bundled to be subjected to various post processings such as bookmaking processing, binding processing, punching, and the like.

(Inserter)

The inserter 102 is provided downstream of the printer 30, and includes a substantially horizontal main conveying path 41 for receiving the sheets (printed sheets) on which images are formed at the image forming apparatus 101, and conveying the sheets to the downstream finisher 103 and a discharge (conveyance) roller 49. The inserter 102 passes-over the sheet received from the image forming apparatus 101 to the finisher 103 at the same speed with the speed when the sheet is received.

Below the main conveying path 41, a plurality of sheet feeding trays 42 and 43 as insert-sheet feeding trays are provided. Further, Above the main conveying path 41, too, there are provided a plurality of sheet feeding trays and 45 as the insert-sheet feeding trays. The respective sheet feeding trays 42, 43, 44, and 45 are capable of being pulled out in a forward direction of the apparatus.

The sheet feeding trays 42 to 45 each function as sheet accommodation units for accommodating the insert-sheet to be conveyed.

The sheet feeding trays 42, 43, 44, and 45 each having a large capacity separate one by one the cover pages and the sheet-bundle as the interleaving sheets, which are accommodated on the respective trays, to convey them to the finisher 103 through the main conveying path 41. In this case, on the sheet feeding trays 42, 43, 44, and 45 of the inserter 103, the special sheets are loaded.

The special sheets referred herein are sheets, which are demanded on the POD market, and indicate various materials, for example, color paper, a cover, color preprint paper, and the like. The user loads desire insert-sheets to be inserted, on the sheet feeding trays 42, 43, 44, and 45, under a state in which its surface faces upward (face-up state), or a state in which the surface faces downward (face-down state).

With separated sheet feeding units 42*a*, 43*a*, 44*a*, and 45*a*, the insert-sheets on the sheet feeding trays 42, 43, 44, and 45 are separated and fed one by one in an order from an upper most sheet.

The above-mentioned discharge roller 49 coveys a sheet, which is passed over at a first speed from the image forming apparatus 101, to the finisher 103 at the first speed, and conveys a sheet, which is passed over at a second speed from the image forming apparatus 101, to the finisher 103 at the second speed. Further, the discharge roller 49 conveys the sheets, which are fed from the sheet feeding trays 42, 43, 44, and 45, to the finisher 103 at any one of the first speed and the second speed. Specifically, the discharge roller 49 functions as a sheet conveyance unit.

Further, a conveying speed controller 317 of FIG. 3 controls the conveying speed of the discharge roller 49. Further, the conveying speed controller 317 controls the conveying speeds of the sheets, which are fed from the sheet feeding trays 42, 43, 44, and 45, and are discharged to the finisher 103, with the discharge roller 49, based on the conveying speed when one-preceding sheet is discharged to the finisher 103, or on the conveying speed when the succeeding sheet is to be discharged to the finisher 103. Specific description is described with reference FIG. 6 described later.

(Finisher)

The finisher 103 introduces the sheets in an order discharged from the inserter 102 (sheets from the image forming apparatus 101, or insert-sheets from the sheet feeding trays 42, 43, 44, and 45).

Further, the finisher 103 conducts various sheet post processing such as aligning processing of aligning the plurality of introduced sheets into a sheet bundle, staple processing of stapling a trailing end of the aligned sheet-bundle by staples, punching processing of punching a vicinity of the trailing end of the introduced sheet, sorting processing, non-sorting processing, and bookbinding processing.

The finisher 103, as illustrated in FIG. 4, includes an entrance roller pair 61 for guiding the sheets discharged from the inserter 102 into inside. The conveying path downstream of the entrance roller pair 61 branches the sheets into a conveying path 62 and a bookbinding path 63, and a flapper (not shown) for switching over the conveying path is provided at its branching point so that the sheets are guided into any one of the paths.

The sheet guided to the conveying path 62 is sent toward a buffer roller 64 through a conveying roller pair (not shown). In the midway of the conveying path 62, a punch unit 65 is provided. The punch unit 65 operates as required, and punches the vicinity of the trailing end of the conveyed sheets.

The buffer roller 64 is a roller capable of laminating and winding a predetermined number of sheets sent thereto on an outer periphery thereof, and a plurality of depressing runners (rollers) (not shown) are provided on the outer periphery of the roller. As required, the sheets are wound on the outer periphery of the depressing runners (rollers). The sheets wound around the buffer roller 64 are conveyed in a rotational direction of the buffer roller 64.

Further, switchover flappers 66 and 67 are arranged near an outer peripheral conveying path of the buffer roller 64.

The switchover flapper 66 on the upstream side is a flapper for peeling off the sheets wound around the buffer roller 64 therefrom and guiding them to a non-sorting path 68 or a sorting path 69.

The switchover flapper 67 on the downstream side is a flapper for peeling off the sheets wound around the buffer roller 64 therefrom and guiding them to the sorting path 69, or a buffer path 70 under a state in which the sheets wound around the buffer roller 64 have been wound.

The sheets guided to the non-sorting path 68 by the switchover flapper 66 are discharged onto a sample tray through a discharge roller pair (not shown). In the midway of the non-sorting path 68, there is provided a discharge sensor (not shown) for detecting jam.

The sheets guided to the sorting path 69 by the switchover flapper 66 are loaded onto a processing tray 72 through a conveying roller (not shown). The sheets loaded into a bundle shape on the processing tray 72 are subjected to the aligning process, stapling process, or the like as needed, and then discharged onto a stack tray 73 by a discharge roller (not shown).

A stapler 74 is used for the stapling process to staple the sheet-bundle loaded on the processing tray 72. The stack tray 73 is constructed so as to be movable in a vertical direction, and is raised and lowered based on a stacked amount of the sheet-bundle.

Besides, the sheets guided to the bookbinding path 63 are stored in a storing guide 76 by a conveying roller pair 75, and are further conveyed until front ends of the sheets are brought into contact with a sheet positioning member 77. The sheet positioning member 77 is movable in the vertical direction, and adjusts the stop position of the sheet-bundle in its conveying direction. Further, a pair of right and left staplers 78 are provided at midway positions of the storing guide 76 so as to staple a center portion of the sheet-bundle.

A folding roller pair 80 is provided at a downstream position of the staplers 78. At a position that faces the folding roller pair 80, there is provided a projecting member 81. By projecting the projecting member 81 toward the sheet-bundle stored in the storing guide 76, the sheet-bundle are pushed out between the pair of folding rollers 80 to be folded by the folding roller pair 80. Then, the folded sheet-bundle is discharged to a saddle discharge tray 83 through a folded sheet discharge roller 82.

Figure 5:
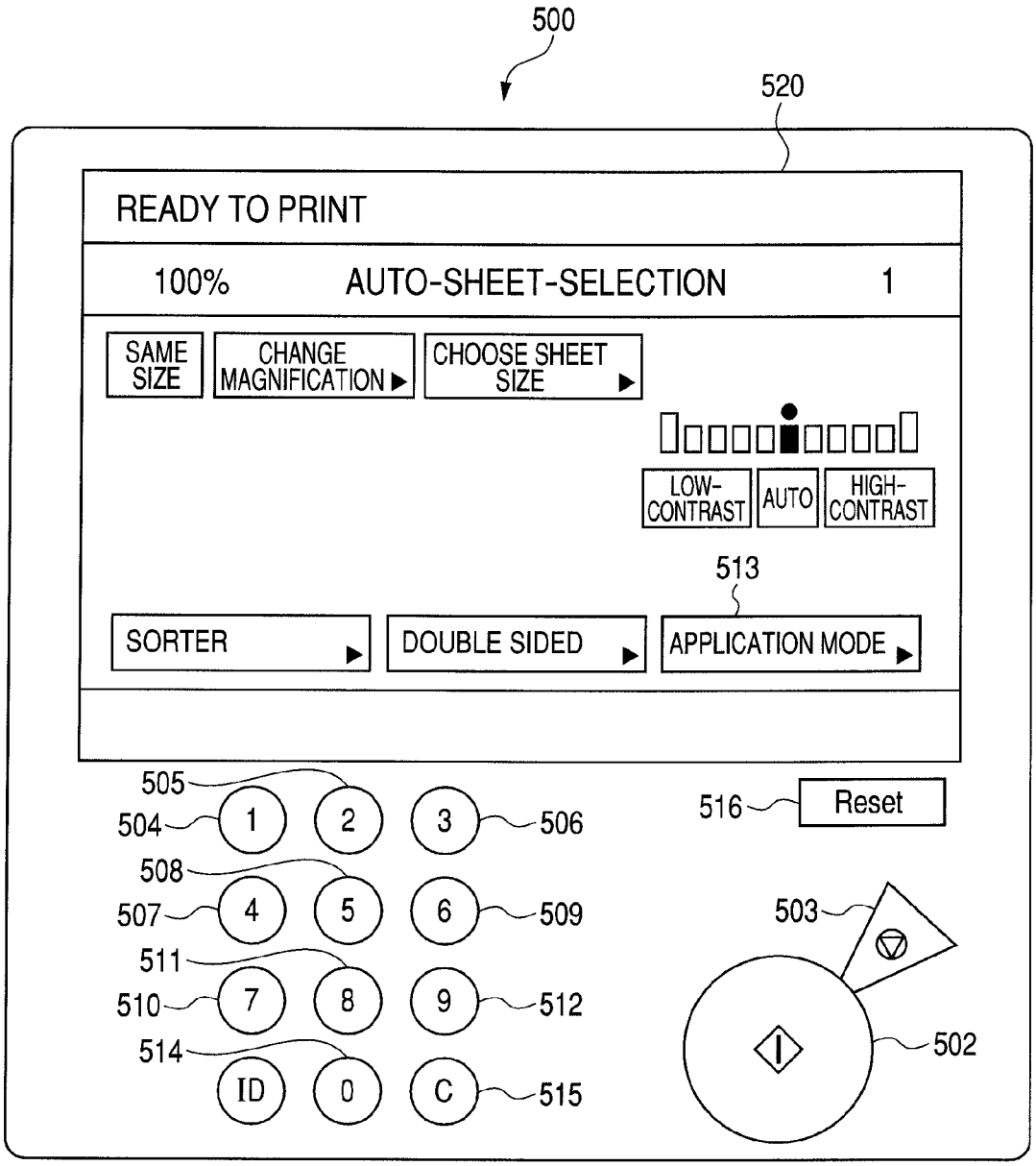
FIG. 5 is a structural diagram of an operation display device of the image forming apparatus of FIG. 4.

FIG. 5 is a structural diagram of an operation display device provided in the image forming apparatus of FIG. 4.

In FIG. 5, to an operation display device 500, there are provided a start key 502 for starting an image formation operation, a stop key 503 for suspending the image formation operation, ten-keys 504 to 512, and 514 for conducting registration setting, and the like. Further, a clear key 515, a reset key 516, and the like are arranged therein.

Besides, a liquid crystal display unit 520 with a touch panel formed on its surface is arranged so that a soft key may be created on its screen, and a sheet insertion mode may be set by depressing an application mode key 513.

Figure 6:
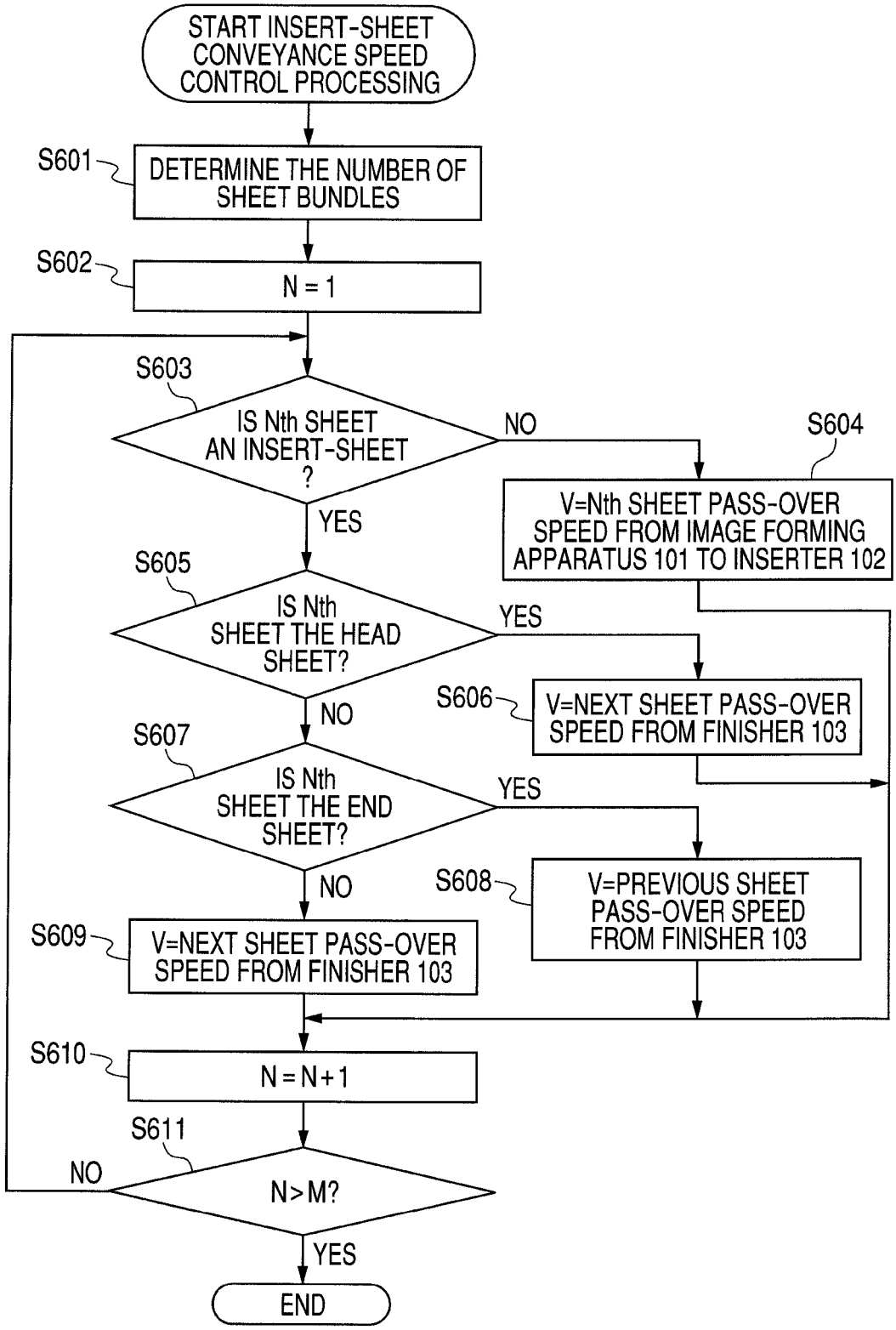
FIG. 6 is a flowchart illustrating a procedure of insert-sheet conveying speed control processing executed by the inserter controller of FIG. 3.

Next, description is made of control of speed at the time when the insert-sheet is passed-over from the inserter 102 to the downstream side device with reference to FIG. 6 to FIG. 8.

FIG. 6 is a flowchart illustrating a procedure of insert-sheet conveying speed control processing executed by the inserter controller 121 of FIG. 3.

Specifically, FIG. 6 is a flowchart illustrating a procedure of determining processing for determining a pass-over speed V of the insert-sheet to the finisher 103.

The inserter controller 121 determines a number of sheets M of one set of the sheet-bundle from the contents of the print job (Step S601). At this time, the insert-sheet is at what page is also determined. Next, the inserter controller 121 sets 1 to variable N representing a target sheet (sheet which is subject for determining pass-over speed) is at what page (Step S602). The inserter controller 121 determines whether N-th sheet is an insert-sheet or not (Step S603). If the N-th sheet is an insert-sheet, the process proceeds to Step S605. On the other hand, if the N-th sheet is not an insert-sheet, namely, the N-th sheet is a sheet discharged from the image forming apparatus 101, the process proceeds to Step S604. In Step S604, the inserter controller 121 sets a conveying speed V, at which the N-th sheet is passed-over to the finisher 103, to the same speed at which the image forming apparatus 101 passed-over the N-th sheet to the inserter 102.

In Step S603, if the N-th sheet is determined as the insert-sheet, the inserter controller 121 determines whether the N-th sheet is a head sheet of the bundle or not (Step S605). Then, if the N-th sheet is the head sheet, the process proceeds to Step S606, and if the N-th sheet is not the head sheet of the bundle, the process transitions to Step S607.

In Step S606, the inserter controller 121 sets the speed V, at which the N-th sheet is passed-over to the finisher 103, to the same speed at which the next sheet is passed-over to the finisher 103. The speed, at which the next sheet (N-th+1) is passed-over to the finisher 103, becomes the same speed at which the inserter 102 receives the next sheet, if the next sheet is a sheet discharged from the image forming apparatus 101. If the next sheet is also the insert-sheet and is not the end sheet, the pass-over speed of the N-th sheet becomes a pass-over speed of N-th+2 sheet. In other words, the speed V, at which the N-th sheet is passed-over to the finisher 103, is set as the same speed at which the sheet next discharged from the image forming apparatus 101 is passed-over to the finisher 103.

In Step S607, the inserter controller 121 determines whether the N-th sheet is the end sheet of the bundle or not (S607). If it is the end sheet of the bundle, the process transitions to Step S608, and it is not the end sheet of the bundle, the process transitions to Step S609.

In Step S608, the inserter controller 121 sets the speed V, at which the N-th sheet is passed-over to the finisher 103, to the same speed at which the next sheet has been passed-over to the finisher 103.

In Step S609, the inserter controller 121 sets the speed V, at which the N-th sheet is passed-over to the finisher 103, to the same speed at which the next sheet is passed-over to the finisher 103. Specifically, as well as in Step 606, the speed V, at which the N-th sheet is passed-over to the finisher 103, is set as the same speed at which the sheet next discharged from the image forming apparatus 101 is passed-over to the finisher 103.

Next, the inserter controller 121 increments a value of the variable N by 1 (Step S610), and determines whether the variable N becomes larger than the number of sheets M or not, namely, as to whether the pass-over speeds with respect to all the sheets are set or not (Step S611). If the settings of the pass-over speeds for all the sheets are not completed, the process returns to Step S603, and the inserter controller 121 repeats the above-mentioned processings. If the settings of the pass-over speeds for all the sheets are completed, the processing is ended.

As a specific example, description is made of a case where a job, in which three sheets of the sheet as one set are loaded onto the finisher 103, is executed. In this case, it is assumed that the first sheet is an insert-sheet fed by any one of the sheet feeding trays 42 to 45 of the inserter 102, the second sheet is a print sheet, which is printed by the image forming apparatus 101 and is discharged under a state in which an image surface is faced up, and the third sheet is the insert-sheet, as well as the first sheet, which is fed by any one of the sheet feeding trays 42 to 45 of the inserter 102. Further, it is assumed that the pass-over speed of the sheet, which is passed-over from the image forming apparatus 101 to the inserter 102 in the face-down state is set as Vd, and the pass-over speed of the sheet, which is passed-over from the image forming apparatus 101 to the inserter 102 in the face-up state or in a two-sided state is set as Vf (<Vd). It should be noted that the above-mentioned two-sided state of the image surface refers to a state in which the images are formed on both surfaces of the sheet.

If the above-mentioned conditions are applied to the flowchart of FIG. 6, the first sheet is an insert-sheet, and is the first sheet of the bundle. Accordingly, the pass-over speed of the sheet from the inserter 102 to the finisher 103 becomes the same with the pass-over speed of the next (second sheet) sheet from the inserter 102 to the finisher 103 (Step S606).

The inserter 102 passes-over the sheet received from the image forming apparatus 101 to the finisher 103 at the same speed with the pass-over speed. The second sheet is a sheet which is received from the image forming apparatus 101 in the face-up state, and hence the pass-over speed of the sheet from the inserter 102 to the finisher 103 becomes Vf. Accordingly, the pass-over speed of the insert-sheet, which being the first sheet, to the finisher 103 also becomes Vf. Accordingly, there is no need for the finisher 103 to switchover the speed when receiving the second sheet.

The third sheet is the insert-sheet, and is the end sheet of the bundle. Accordingly, the pass-over speed of the third sheet to the finisher 103 becomes Vf, which is the same with the pass-over speed of the second sheet.

As described above, as the pass-over speeds of all three sheets from the inserter 102 to the finisher 103 are set to Vf, it is found that the number of times for switching over the speed of the conveying roller, which is necessary for the finisher 103 to receive the three sheets, becomes 0 times, which is a minimum time (refer to FIG. 7).

Next, description is made of a case where a job, in which a sheet insertion mode is set through the operation display device 500, and two sets of four sheets of the sheet are loaded onto the finisher 103, is executed.

In this case, the first sheet is an insert-sheet which is fed by any one of the sheet feeding trays 42 to 45 of the inserter 102, and the second sheet is a print sheet which is discharged from the image forming apparatus 101 under a state in which the image surface is in the face-down state. Further, it is presumed that the third sheet is a print sheet which is discharged from the image forming apparatus 101 under a state in which the image surface is in the face-up state, and the fourth sheet is an insert-sheet which is fed by any one of the sheet feeding trays 42 to 45 of the inserter 102.

If the above-mentioned conditions are applied to the flowchart of FIG. 6, the first sheet is an insert-sheet, and is the first sheet of the bundle. Accordingly, the pass-over speed V of the sheet from the inserter 102 to the finisher 103 becomes the same with the pass-over speed of the second sheet from the inserter 102 to the finisher 103.

Besides, the second sheet is a print sheet which is discharged in the face-down state, and hence the pass-over speed V of the sheet to the finisher is set to Vd. Accordingly, the pass-over speed V of the first sheet from the inserter 102 to the finisher 103 is also set to Vd. Further, as the third sheet is a print sheet which is discharged in the face-up state, the pass-over speed V of the third sheet from the inserter 102 to the finisher 103 is set to Vf.

The fourth sheet is an insert-sheet, and is an end sheet of the bundle. Accordingly, the pass-over speed V of the fourth sheet from the inserter 102 to the finisher 103 becomes the same speed of Vf, which is the pass-over speed of the third sheet. The fifth to eighth sheets of the second set are the same with the first to fourth sheets of the first set.

As described above, it is found that the number of times for switching over the speed of the conveying roller, which is necessary for the finisher 103 to receive the two sets of the four sheets becomes three times (refer to FIG. 8).

According to the embodiment of the present invention as described above, even in a case where the insertion of the insert-sheet is executed from the inserter 102, by controlling the pass-over speed of the sheet to the downstream side device using the bundle information of the insert-sheet, it is possible to minimize the number of times for switching over the conveying speed when the downstream side device receives the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-159157, filed Jun. 18, 2008, which is hereby incorporated by reference herein in its entirety.

What is claimed is:

1. An inserter for feeding an insert-sheet forming a sheet bundle with a printed sheet which is discharged from an image forming apparatus, the inserter comprising:

a storing unit that stores the insert-sheet;

a sheet-feeding unit that feeds the insert-sheet stored in the storing unit;

a conveyance unit that discharges the printed sheet discharged from the image forming apparatus connected upstream of the inserter and the insert-sheet fed by the sheet-feeding unit to a downstream side device connected to downstream of the inserter; and a controller that determines conveying speeds of the insert-sheet and the printed sheet to be discharged to the downstream side device by the conveyance unit, wherein the controller determines a conveying speed of a printed sheet, which is discharged from the image forming apparatus at a first speed and discharged to the downstream side device by the conveyance unit, as the first speed;

the controller determines a conveying speed of a printed sheet, which is discharged from the image forming apparatus at a second speed and discharged to the downstream side device, as the second speed; and the controller determines a conveying speed of the insert-sheet discharged to the downstream side device by the conveyance unit, based on a conveying speed of the printed sheet discharged to the downstream side device, the printed sheet being a sheet discharged first after or last before the insert sheet is discharged to the downstream side device.

2. An inserter according to claim 1, wherein, in a case where the insert-sheet fed by the sheet-feeding unit is a head sheet of one set of a sheet bundle, the controller determines the conveying speed of the insert-sheet discharged to the downstream side device, based on a conveying speed of the printed sheet discharged to the downstream side device, the printed sheet being a sheet discharged first after the insert-sheet is discharged to the downstream side device.

3. An inserter according to claim 1, wherein, in a case where the insert-sheet fed by the sheet-feeding unit is an end sheet of one set of a sheet bundle, the controller determines the conveying speed of the insert-sheet discharged to the downstream side device, based on the conveying speed of the printed sheet discharged to the downstream side device, the printed sheet being a sheet discharged last before the insert-sheet is discharged to the downstream side device.

4. An inserter according to claim 1, wherein, in a case where the insert-sheet fed by the sheet-feeding unit is not any of a head sheet and an end sheet of one set of a sheet bundle, the controller determines the conveying speed of the insert-sheet discharged to the downstream side device, based on the conveying speed of the printed sheet discharged to the downstream side device, the printed sheet being a sheet discharged first after the insert-sheet is discharged to the downstream side device.

* * * * *